United States Patent [19]

King

[11] Patent Number: 4,858,867

[45] Date of Patent: Aug. 22, 1989

[54] GARMENT BAG SUPPORT HOOK

[75] Inventor: William L. King, Denver, Colo.

[73] Assignee: Samsonite Corporation, Denver, Colo.

[21] Appl. No.: 196,886

[22] Filed: May 18, 1988

Related U.S. Application Data

[63] Continuation of Ser. No. 108,836, Oct. 15, 1987, abandoned.

[51] Int. Cl.[4] ..... E04G 5/06

[52] U.S. Cl. ..... 248/214; 248/340

[58] Field of Search ..... 248/340, 339, 215, 214, 248/324, 304, 322; 211/113, 115; 206/286

[56] References Cited

U.S. PATENT DOCUMENTS

| | | | |
|---|---|---|---|
| 70,884 | 11/1867 | Oatley . | |
| 895,047 | 8/1908 | Schraudner | 248/215 X |
| 1,078,729 | 11/1913 | Hill | 211/115 X |
| 1,948,014 | 2/1934 | Tuttle | 211/115 |
| 2,112,190 | 6/1938 | Wendt | 248/214 |
| 2,459,417 | 1/1949 | Dodge | 211/115 X |
| 3,179,363 | 5/1962 | Sheiman . | |
| 3,221,848 | 9/1962 | O'Neil . | |
| 3,907,118 | 9/1975 | Pelavin | 248/214 X |
| 4,004,770 | 1/1977 | Karass | 248/215 X |
| 4,027,842 | 6/1977 | Mittleman | 248/215 X |
| 4,095,768 | 6/1978 | Chasen | 248/304 X |
| 4,098,483 | 7/1978 | Pesola | 248/304 X |
| 4,342,479 | 8/1982 | Hofer . | |

OTHER PUBLICATIONS

Photocopy of Samsonite garment bag hook.

Photocopy of Lark Luggage Company garment bag hook.

*Primary Examiner*—J. Franklin Foss

*Attorney, Agent, or Firm*—Gregory W. O'Connor

[57] ABSTRACT

A garment bag hook containing parallel support legs adapted to grip opposite sides of a door to support the bag from the door. The legs are connected together by support surfaces which allow the bag to be suspended from a horizontal rod. A ring or loop swivelly attached to the hook adjacent one of the support legs facilitates the rotation of the garment bag from front to back as it is supported on a door.

17 Claims, 2 Drawing Sheets

FIG. 2.
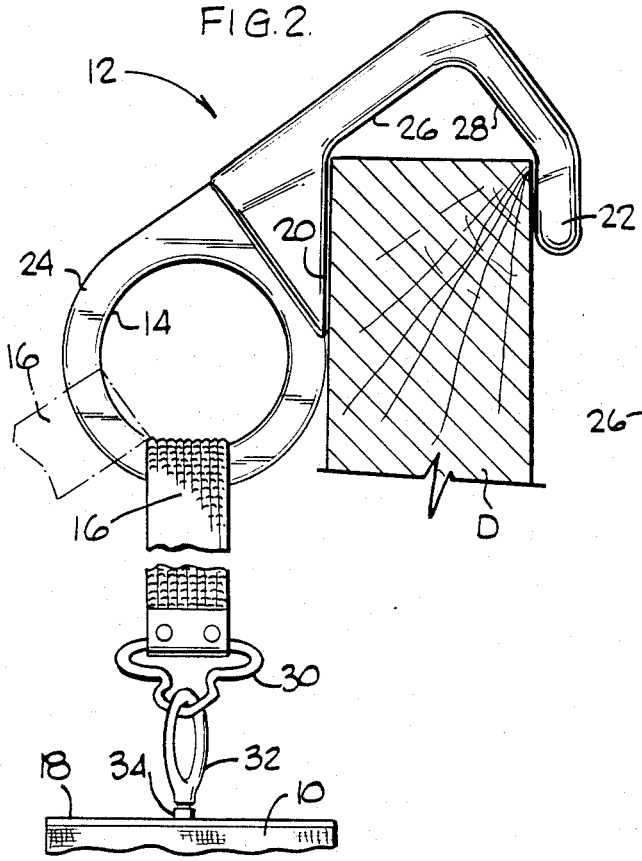
FIG. 3.
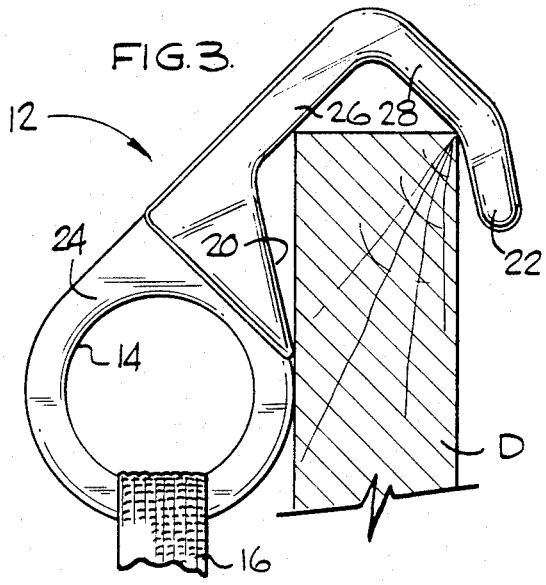
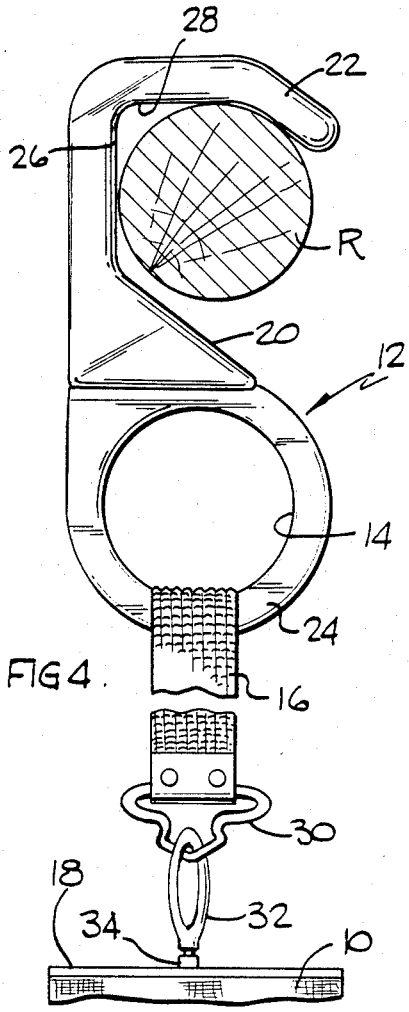
FIG 4.

GARMENT BAG SUPPORT HOOK

This is a continuation of co-pending application Ser. No. 108,836 filed on Oct. 15, 1987, now abandoned.

FIELD OF THE INVENTION

This invention relates to a hook for suspending a garment bag from a support. More particularly, it relates to a garment bag hook which allows the bag to be suspended from either a door or a horizontal support pole.

BACKGROUND OF THE INVENTION

Hooks are commonly attached to the top panel of garment bags so that the bags in their unfolded condition can be hung from a support rod. In order to function properly the hooks merely have to have an opening large enough to enable them to be placed over a horizontal support rod in the same manner as a clothes hanger hook. At times, however, the only support means available is a door. At other times both a rod and a door may be available but either one or the other may be preferred depending on the type of bag being used and the amount of bag maneuvering space available.

A deficiency of hooks designed to support a garment bag only from a horizontal rod or pole is that they cannot be used to support the bag from a door unless used in connection with a special support clamp which fits over the top edge of the door. The support clamp normally has an upturned leg or flange extending a short distance down from the top of the door which receives and supports the garment bag hook.

In order to enable the user to hang a garment bag from either type of support it has been proposed to provide a support hook capable of being used in connection with either a door or a rod. U.S. Pat. No. 3,179,363 to Sheiman, for example, discloses a garment bag having a wire hook of special configuration attached at its lower end to the top panel of the bag. The curved hook is adapted to fit over a support rod or over the top edge of a door. In the latter case the opposing faces of the hook are pulled by the weight of the hanging garment bag against the upper corners of the door to hold the garment bag in place. This arrangement, however, is not fully satisfactory. Since the hook engages only the corners of the upper door edge the garment bag is not as stable as desired. Further, if the user wishes to fill the bag through both faces it is necessary to first insert the garments through an opening in the exposed face, then lift the bag from the door and hang it again so that the opposite face is exposed. Although it would be preferable to be able to rotate the bag while it is supported on the door in order to expose the opposite side of the bag, the Sheiman hook design does not permit the bag to be adequately maneuvered to carry out this function.

Another type of hook that has been employed has a very wide opening between the shank extending from the top panel of the garment bag and the downwardly extending free end which together form the hook configuration. This arrangement allows the hook to be used in connection with both a horizontal support pole and a door. If used with a door, one face of the door is contacted by the free end portion of the hook while the other face is contacted only by the garment bag itself. Although the bag can be supported on the door through this arrangement, it is not adapted to be rotated while hanging in order to expose the opposite face of the bag.

Still another prior art arrangement consisted of a hook having a shank portion connected to a curved portion adapted to fit over a horizontal support rod. The shank was long enough to permit the hook to fit over a door, with parts of the shank and the curved portion of the hook being spaced from and overlying the top edge of the door. The shank portion in such an arrangement was at an angle to the top edge of the door. Depending upon the thickness of the door, either the tip of the free end of the hook or a point on the adjacent curved portion of the hook engaged one side of the door. The other side of the door was engaged by a metal loop mounted on a portion of the hook extending outwardly from the shank. The loop was mounted for rotation in a swivel connection the axis of which was substantially parallel to the shank, and a strap connecting the garment bag to the hook was attached to the loop. This loop comprised a slot whose narrow dimension was shorter than the width of the strap, thus constraining the strap parallel to the axis of the swivel. The purpose of this design was to allow the garment bag to be rotated with respect to the hook by means of the rotating swivel connection of the loop, so that the garment bag could be reversed without being removed from the door. Thus tension on the strap caused the hook to align itself to the strap with the potential of gouging the top of the door. Another problem with this arrangement is that both the rotating strap loop and the swivel connection of the loop gouged the face of the door, making the hook unacceptable.

It would be desirable to have a support hook which can be used to support a garment bag from either a horizontal rod or the top of a door in an improved manner so that when used with a door the bag will remain in a stable position and not mar the surface of the door. It would also be desirable for such a hook to allow the bag to be conveniently rotated while hanging on a door in order to expose the opposite face of the bag.

BRIEF SUMMARY OF THE INVENTION

This invention provides a garment bag hook which has first and second legs spaced a substantial distance apart and being connected to each other by additional support surface means. The first and second legs are adapted to contact the opposite faces of a door when the hook is placed over the top of the door and to be substantially vertically aligned when the thickness of the door is substantially equal to the spacing between the legs. The support surface means is adapted to support the bag from a horizontal rod in such a way that the first and second legs extend at an angle to the vertical. In addition, the hook is connected to the garment bag by means permitting the bag to rotate relative to the hook to enable the bag to be used in connection with either a horizontal support rod or the top of a door and to permit it to be maneuvered while hanging on the door.

In a preferred embodiment the hook is connected to the garment bag by a strap capable of sliding along the surface of the loop to which it is attached to facilitate the ability of the bag to rotate with respect to the hook. This action can be further facilitated and enhanced through use of a swivelly mounted ring or loop to which the strap is connected.

Other features and aspects of the invention, as well as its various benefits, will become more clear in the detailed description of the preferred embodiment which follows.

BRIEF DESCRIPTION OF THE DRAWINGS

FIG. 2 is an enlarged side elevation of the hook, showing it in place on a door;

FIG. 3 is a view similar to that of FIG. 2, but showing the garment bag hook in place on a door of lesser thickness;

FIG. 4 is an enlarged side elevation of the hook of FIG. 2, but showing it in place on a horizontal support rod;

DESCRIPTION OF THE PREFERRED EMBODIMENT

Figure 1:
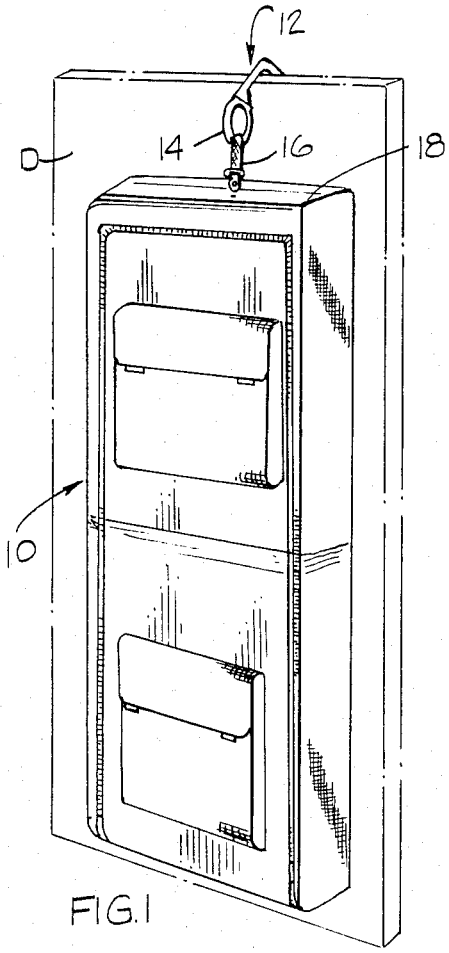
FIG. 1 is a pictorial view of a garment bag suspended from the top of a door by the hook of the present invention.

Referring to FIG. 1, a garment bag 10 is shown supported from the top of a door D by the hook 12 of the present invention. The hook contains a circular aperture 14 through which a strap 16 attached to the top panel 18 of the garment bag extends. The strap extends a considerable distance between the top panel 18 and the aperture 14, preferably in the range of about 8 to 10 inches.

As shown in FIG. 2, the hook 12 comprises a first relatively long leg 20 and an opposing relatively short parallel leg 22 each having surfaces facing one another which extend along substantially the full length thereof. The legs are shown spaced apart a distance equal to the thickness of the door D, and in this position are vertically aligned so that the full length of each leg is in contact with opposite sides of the door. The thickness of the door in this case would correspond to the most commonly encountered thickness of relatively thick doors. The weight of the garment bag 10 pulling down on the loop 24 surrounding the lower portion of the aperture 14 causes the leg 20 to be urged into contact with the door. The same force causes the leg 22 to be urged into contact with the opposite side of the door, thereby effectively clamping the hook onto the door so as to be able to support the weight of a fully loaded garment bag. Support surfaces 26 and 28 extend inwardly from the legs 20 and 22, respectively, and meet at a point intermediate the legs, forming a right angle with each other. In the illustrated arrangement the support surfaces 26 and 28 are spaced from the top of the door.

The strap 16, which may be of any suitable flexible material, extends through the aperture 14 over the loop 24 so as to be able to slide along the loop. The other end of the strap is connected to a link 30 which extends through the eye of a closed hook 32 extending upwardly from a swivel connection 34 mounted in the top panel 18 of the garment bag.

If it is desired to reverse the position of the garment bag to expose the side facing the door in FIG. 1, the user merely angles the garment bag away from the door while keeping the strap 16 taut. This causes the strap to slide along the loop 24 to a position such as that illustrated in phantom in FIG. 1. Because the strap is relatively long, the garment bag will be spaced a sufficient distance from the door to allow the bag to be rotated to reverse the positions of the ends of the top panel 18, following which the bag can be allowed to move back toward the door. As this occurs the strap slides back along the loop 24 to again assume the vertical alignment shown in FIG. 1, allowing the user to load garments through a panel on the newly exposed side of the bag. The rotation of the bag is made possible by several features. The swivel connection 34 allows the bag to rotate with respect to the strap, and the loose connection between the link 30 and the hook 32 permits relative rotation between these elements. Additionally, the strap itself, being flexible, is able to twist a considerable degree to allow relative angular movement between the garment bag and the support hook 12. The ability of the strap to slide up the loop also enables the bag to be placed in the proper position prior to rotation thereof.

The hook 12 is also able to support the garment bag from doors which are not as thick as the door illustrated in FIG. 2. Referring to FIG. 3, one upper corner of the door D is engaged by a point on the hook 12 corresponding to the juncture of the short leg 22 and the support surface 28. The opposite side of the door is engaged by a lower portion of the leg 20. The thickness of the door in this illustration corresponds to the thickness of the most commonly encountered door of relatively small thickness. If a door of still smaller thickness were encountered a point on the leg 22 closer to the tip thereof would engage the upper corner of the door while the lower portion of the leg 20 would still engage the opposite side of the door. Because the forces at work in this situation are the same as the forces described in connection with the arrangement of FIG. 2, the hook is stable even when mounted on a relatively thin door, allowing the bag to be rotated in the same manner as described above.

Referring to FIG. 4, the hook 12 is shown supporting a garment bag 10 from a horizontal rod R, such as a closet rod. In this arrangement the strap 16 is in contact with a different portion of the loop 24 to allow the garment bag to hang vertically from the hook. The ability of the strap to slide along the loop permits the garment bag to readily assume this relationship with respect to the support hook. A point on the support surface 26 engages the side of the rod R while a point on the support surface 28 engages the top of the rod. Because the weight of the garment bag urges the support surfaces into the rod, this arrangement is also quite secure and stable. Although not shown, it is obviously possible to hang the hook 12 from a rod of lesser diameter, which will simply cause the points of contact on the support surfaces 26 and 28 to be closer to the juncture of the support surfaces. The slight angle between the support surface 28 and the leg 22 results in the leg 22 assuming a slight downward attitude to approximate the shape of a downwardly extending hooked configuration to further guard against the possibility of slippage between the hook and the rod.

When supported by a rod, as in FIG. 4, the garment bag hook is in a plane which is generally parallel to the direction in which the top panel 18 of the garment bag extends, whereas when supported by a door, as in FIG. 2, the hook is in a plane which is generally at right angles to the direction in which the top panel extends. The relative rotation required to place the hook in this position is easily carried out since the features allowing such movement are the same as those described in connection with FIG. 2.

Figure 5:
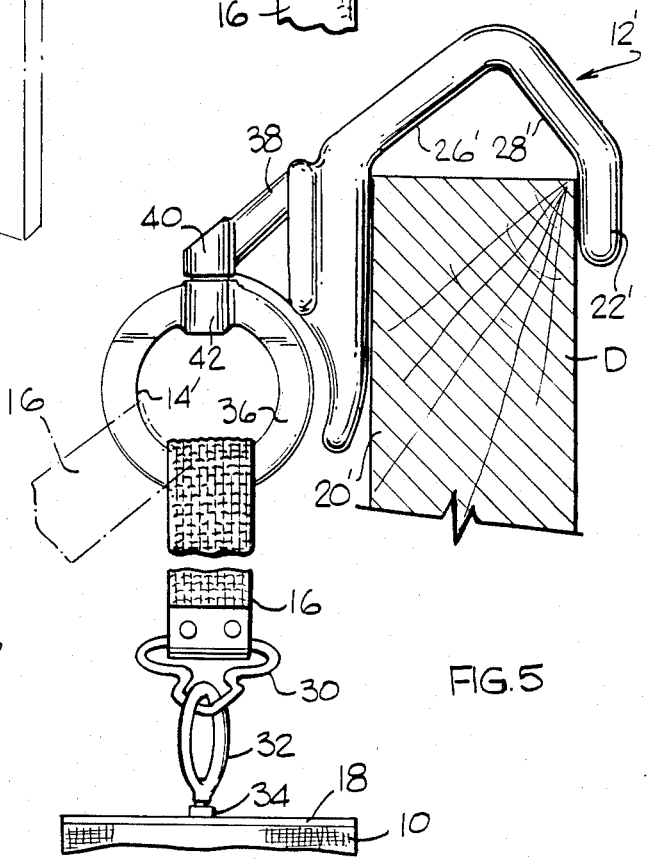
FIG. 5 is a view similar to that of FIG. 2, but showing a modified hook arrangement.

Referring now to FIG. 5, a modified version of the hook of FIGS. 1–4 is shown. The hook 12′ comprises legs 20′ and 22′ and support surfaces 26′ and 28′, all similar in function to the corresponding elements of the hook of FIGS. 1–4. In this embodiment, however, instead of the loop attached to the garment bag strap being integral with the rest of the hook structure, the loop 36 is a separate element attached by a swivel connection to the end of an arm 38 extending from the main body of the hook 12′. Although the swivel connection may be of any desired type, a boss 40 formed on the arm 38 is shown as being in alignment with an enlarged portion 42 in the loop. A stem, not shown, may extend up from within the enlarged portion 42 into the boss 40 for rotational movement therein, the stem being prevented from being withdrawn by any suitable means such as by a pin and groove arrangement. Although not essential, it is preferred, as illustrated, that the axis of the swivel connection between the loop 36 and the arm 38 be parallel to the legs 20′ and 22′.

Figure 6:
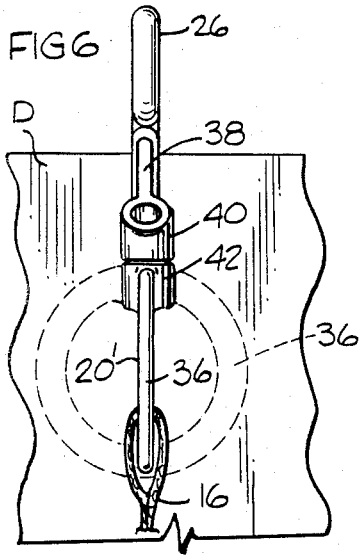
FIG. 6 is a front elevation of the hook arrangement of FIG. 5.

The hook 12′ is retained on the door in the same way as described in connection with the hook of FIG. 2. When it is desired to reverse the garment bag to expose the side that was facing the door, however, the ability of the loop 36 to rotate supplements the other relative rotational movements described in connection with FIG. 2. This added ability to cause relative rotational movement, in cooperation with the ability of the strap 16 to slide on the loop 36 to the position shown in phantom, makes it easier still for a user to rotate the garment bag to the degree necessary to turn it around on the door. As shown in FIG. 6, the ring or loop 36 will assume the position shown in phantom when the loop is rotated a quarter turn. If it is rotated a half turn, as it would be if the loop accounted for the entire rotational movement of the bag during its reversal on the door, the loop would once again appear as in FIGS. 5 and 6, although the opposite side of it would be facing the viewer. By separating the loop from the door by the intervening structure of leg 20′, the loop is free to rotate without danger of conatacting and marring the surface of the door. The parallel alignment of the swivel connection of the loop 36 to the legs 20′ and 22′ permits the hook to have an overall compact shape, particularly when supporting a garment bag from a support rod.

Figure 7:
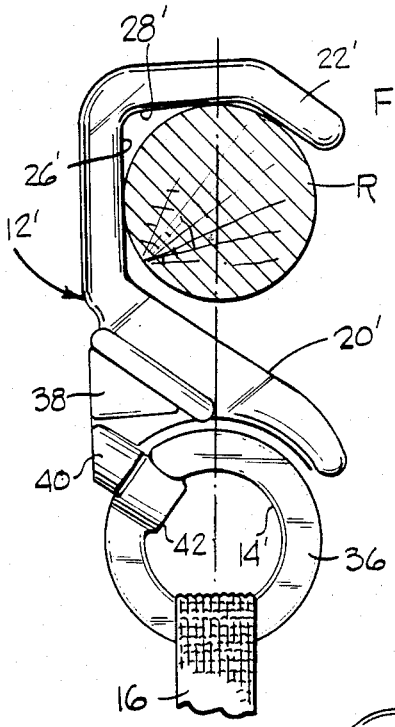
FIG. 7 is a view similar to that of FIG. 4, but showing the hook of FIG. 5 instead.

Referring to FIG. 7, the hook 12′ is shown supported on a horizontal rod R similar to the arrangement of FIG. 4. The rotatably mounted loop 36 does not affect the functioning of the hook 12′ in this environment, and so the comments directed to the hook 12 in connection with FIG. 4 apply equally as well to the FIG. 7 arrangement.

The hooks described herein may be formed of any suitable material possessing the necessary structural strength. If a metal hook is used it may be desirable to apply a suitable wear coating of plastic to the metal to decrease the chance of slippage of the hook on a door surface and to prevent the metal from marring the door.

Although the invention has been described as incorporating a flexible strap between the hook loop and the garment bag, other elements capable of performing a similar function, such as a chain, could be used instead.

It will now be appreciated that the present invention provides a simple, inexpensive, yet highly functional garment bag hook which can be used to support a garment bag from either a horizontal rod or the top of a door while also having the ability to enhance the rotation of a garment bag hanging from a door to allow the bag to be reversed without being removed from the door.

It should be obvious that although a preferred embodiment of the invention has been described, changes to specific details of the embodiment in addition to or instead of the possible modifications suggested herein, can be made without departing from the spirit and scope of the invention defined in the appended claims.

What is claimed is:

1. In a garment bag, hook means for hanging the garment bag from a support, comprising:
   - a first leg;
   - a second leg spaced a substantial distance from the first leg;
   - support surface means connecting the legs;
   - the first and second legs being adapted to contact opposite sides of a door near the top thereof when the hook means is used to support the garment bag from the door;
   - means for connecting the hook means to the garment bag to permit the garment bag to rotate relative to the hook means when the garment bag is supported by the hook means; wherein said means for connecting the hook means to the garment bag comprises a normally vertically oriented, closed loop attached to the first leg and a strap passing through said loop and connecting the top panel of the garment bag to said loop.

2. In a garment bag, hook means for hanging the garment bag from a support comprising:
   - a first leg;
   - a second leg spaced a substantial distance from the first leg;
   - support surface means connecting the legs;
   - the first and second legs being adapted to contact opposite sides of a door near the top thereof when the hook means is used to support the garment bag from the door, the legs being substantially vertically aligned when the thickness of the door is substantially equal to the spacing between the first and second legs;
   - the support surface means being adapted to contact the top portion of a horizontal cylindrical support rod when the hook means is used to support the garment bag from the rod, the first and second legs extending at an angle to the vertical when the garment bag is supported from the rod; and
   - an elongated flexible strap and a swivel connection connecting the hook means to a top panel of the garment bag to permit the first and second legs of the hook means to assume the aforesaid positions and to permit the garment bag to rotate relative to the hook means when the garment bag is supported by the hook means.

3. A hook means for hanging a garment bag and the like comprising:
   - a first leg, a second leg spaced from said first leg so that a door of conventional thickness can be received therebetween, the opposed vertical surfaces of the door being engaged by respective first and second legs when said hook is placed over an upper edge of said door, a support surface means connecting the legs; the support surface means being adapted to contact the top portion of a horizontal support rod when the hook means is used to support a garment bag from the rod, and the first and second legs extending at an angle to the vertical when the bag is supported by the hook from the rod, a rigid loop affixed to said first leg on a side thereof opposite from said second leg, said loop presenting an opening having a curved surface for receiving said elongated flexible means, a first portion of said curved surface engaging said elongated flexible means when said first leg substantially extends along the vertical and a second portion of said curved surface engaging said elongated flexible means when said first leg extends at an angle to the vertical.

4. Garment bag hook means according to claim 2 or 3, wherein substantially the entire lengths of said facing surfaces of the first and second legs are in contact with the sides of a door when the hook means is used to support the garment bag from the door.

5. Garment bag hook means according to claim 2 or 3, wherein the support surface means comprises first and second support surfaces extending from the first and second legs at angles thereto and at angles to each other, the first and second support surfaces being connected to each other intermediate the first and second legs.

6. Garment bag hook means according to claim 5, wherein the first and second support surfaces contact upper and side portions of a horizontal rod from which the garment bag is supported.

7. Garment bag hook means according to claim 6, wherein the first support surface is substantially vertical when contacting a side portion of a horizontal rod from which the garment bag is supported.

8. Garment bag hook means according to claim 2 or 3, wherein the means connecting the hook means to the garment bag comprises support means associated with the first leg and elongated flexible means connecting the top panel of the garment bag to said support means, the elongated flexible means being slidably connected to said support means.

9. Garment bag hook means according to claim 2, wherein the elongated flexible means is connected to the top panel of the garment bag by a swivel connection.

10. Garment bag hook means according to claim 8, wherein the support means associated with the first leg includes an enclosed loop connected to said support means by a swivel connection enabling the loop to rotate with respect to the first leg, the loop including an arcuate portion along which the elongated flexible means is adapted to slide.

11. Garment bag hook means according to claim 10, wherein the swivel connection is mounted for rotation about an axis parallel to the length of the first leg.

12. Garment bag hook means according to claim 10, wherein the first leg lies between the loop and the door when the hook means is used to support the garment bag from a door.

13. A hook means as set forth in claim 3 wherein said elongated flexible means comprises a length of strap passing through said loop and engaging said curved surfaces thereof.

14. In a garment bag, hook means for hanging the garment bag from a support comprising a first leg, a second leg, means connecting said first leg and second leg a spaced distance apart, a loop projecting from a side of said first leg opposite from said second leg, at least a portion of said loop being integrally formed by said first leg, said loop extending a substantial distance along the length of said first leg, flexible means associated to a top panel of said garment bag and attached to said enlarged loop so that, when said hook is attached to the upper part of a door or the like, said flexible means is suspended from said enlarged loop and spaced from the side of said door.

15. A hook means as set forth in claim 14 wherein said flexible means includes a strap, said flexible means is connected to said enlarged loop by said strap passing through said loop.

16. A hook means as set forth in claim 14 wherein said flexible means includes a swivel connection.

17. A hook means as set forth in claim 15 wherein said loop includes a curved inner surface along which said strap can slide from a first position in said loop when said hook is supported on the top portion of a door to a second position when said hook is suspended from a horizontal cylindrical support rod.

* * * * *